United States Patent [19]

Wilson

[11] Patent Number: 4,663,633

[45] Date of Patent: May 5, 1987

[54] VEHICLE MOUNTED SATELLITE ANTENNA SYSTEM

[76] Inventor: John E. Wilson, 12736 E. 39th St., Tulsa, Okla. 74146

[21] Appl. No.: 787,131

[22] Filed: Oct. 15, 1985

[51] Int. Cl.[4] ..... H01Q 1/32

[52] U.S. Cl. ..... 343/714; 343/880; 343/840

[58] Field of Search ..... 343/711, 712, 713, 714, 343/880, 881, 882, 840

[56] References Cited

U.S. PATENT DOCUMENTS

| | | | |
|---|---|---|---|
| 3,412,404 | 11/1968 | Bergling | 343/714 |
| 3,739,387 | 6/1973 | Budrow et al. | 343/714 |
| 4,309,708 | 1/1982 | Sayovitz | 343/713 |

*Primary Examiner*—Eli Lieberman

*Attorney, Agent, or Firm*—Head, Johnson & Stevenson

[57] ABSTRACT

A satellite antenna particularly adapted for use on a recreational vehicle such as a house trailer or mobile home, having a roof surface, the antenna including a base plate mounted on the vehicle roof surface, a support plate rotatably secured to the base plate and rotatable about a generally vertical axis for at least about 360 degrees, a parabolic satellite signal reflector having a focal axis, the reflector being pivotally secured to the support member, a variable length member, such as a screw type cylinder for selectively pivoting the parabolic reflector relative to the support member, and a feed arm pivotally secured to one end to the parabolic reflector, a signal receiving feed horn mounted on the other end of the feed arm, the feed arm being pivotal to a position wherein the feed horn is coincident with the focus apex of the reflector and to a rest position in which the feed horn is retained within the confines of the reflector interior surface and linkage means to automatically pivot the feed arm to the rest position when the parabolic reflector is pivoted to the rest position.

6 Claims, 7 Drawing Figures

VEHICLE MOUNTED SATELLITE ANTENNA SYSTEM

SUMMARY OF THE INVENTION

The use of parabolic reflector satellite antenna systems is well known. Most such systems are established for use at a fixed location, that is, the location of the antenna does not change. Stationary systems are completely satisfactory for the satellite receiver antenna is used to supply signals such as to a residence, apartment complex, motel, office building, etc. With such stationary systems the parabolic reflector portion of the antenna remains substantially always in a fixed operating position with provision normally being made for minor adjustments depending upon specific satellites from which signals are to be received.

A more difficult problem exists in providing satellite antenna systems for mobile use. A particular problem exists for users of trailer homes, motor homes, etc., wherein the recreational type vehicle is frequently moved from one location to another. Many users of trailers and motor homes change the position of the motor home almost daily during travel. When a house trailer or mobile home is parked at a temporary location it is usually impossible to align the motor home or trailer in a preselected orientation. Therefore, in order to successfully receive signals transmitted by satellite, an antenna system must be provided which is completely flexible to orient a parabolic reflector so as to be able to point the focal axis of the reflector towards a desired satellite transmitter irrespective of the orientation or location of the recreational vehicle structure to which it is attached.

The present invention solves the problem of providing satellite signal reception for recreational type vehicles. A base plate is secured to the upper surface of the vehicle. Extending upwardly from the base plate is a vertical post. A support member, which may also be in the form of a flat plate, has an opening therein which rotatably receives the post. Affixed to the upper end of the post, above the support plate member, is a fixed gear.

Attached to the support plate is a worm gear which engages the fixed gear. An electric gear motor is connected to drive the worm gear. By providing electrical energy to the gear motor the support plate member may be rotated freely through 360 degrees.

Pivotally attached to the base plate is a parabolic satellite signal reflector having an inner concave surface and an outer convex surface and having a focal axis. The degree of pivotation of the reflector to the support plate is controlled by a screw-type cylinder also driven by an electrically actuated gear motor. By controlling electrical signals to the gear motor the degree of pivotation of the parabolic reflector may be adjusted so that the focal axis may be oriented onto a selected satellite transmitter.

Of particular importance to the invention is provision of means to place the satellite antenna into a stored, low profile position. For this purpose the antenna system includes a feed arm having one end attached to the parabolic reflector. The other end of the feed arm supports a feed horn which receives electromagnetic signals transmitted from the satellite and reflected from the inner surface of the parabolic reflector. The feed arm is pivotal between a raised, operating position and a rest position. In the rest position the feed horn is moved to be received within the confines of the parabolic reflector concave inner surface. This is achieved automatically by means of a linkage system secured to the reflector rearward surface.

By the unique provisions of this invention the parabolic reflector may be oriented to receive the signals of a satellite transmitter at any location of the satellite transmitter above the earth's horizon and irrespective of the orientation of the vehicle on which the antenna is positioned. In addition, and most important, the antenna is readily returned to a rest position in which the focal axis of the parabolic reflector is substantially vertical and the feed horn is retained within the parabolic reflector to provide a low profile, low wind resistance antenna system.

For background information as to other types of parabolic reflector satellite receiving antenna systems reference may be had to the following U.S. Pat. Nos. 3,587,104; 3,665,477; 3,739,387; 3,803,614; 3,412,404; 4,295,621; 3,527,435; 3,714,660; 4,204,214; 4,126,865; 4,404,565; 4,086,599. 4,232,320;

The first three listed patents are deemed to be the most relevant of the prior art found relating to antenna systems for recreational vehicles.

The invention will be better and more fully understood with reference to the following description and claims, taken in conjunction with the attached drawings.

DESCRIPTION OF A PREFERRED EMBODIMENT

Figure 6:
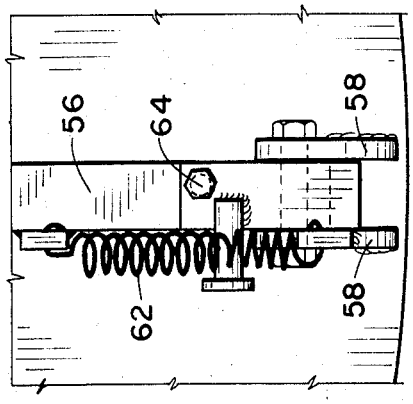
FIG. 6 is an fragmentary end view taken along the line 6—6 FIG. 2 showing the details of the spring employed to automatically move the feed arm to the raised position when the parabolic reflector is pivoted to an operating position.
Figure 1:
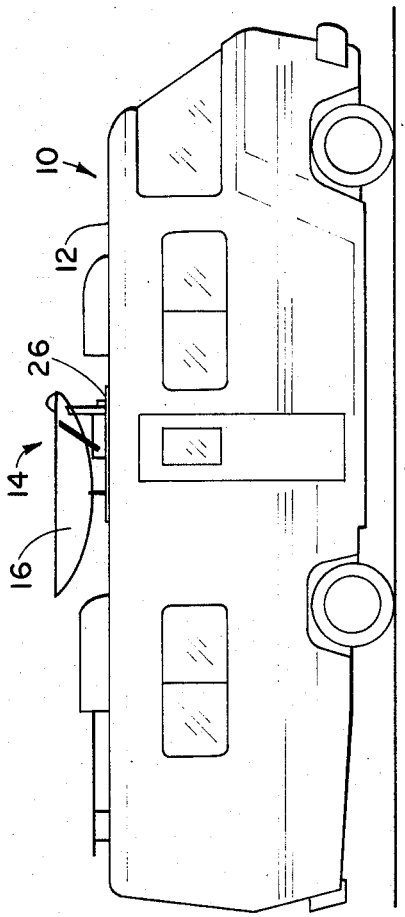
FIG. 1 is an elevational view of a typical recreational vehicle in the form of a motor home and showing the satellite receiver system of this invention in rest position.

Referring first to FIG. 1, a recreational vehicle such as a motor home is indicated by the numeral 10 with a satelitte receiving system of this invention mounted on the vehicle roof surface 12, the satellite receiver system being generally indicated by the numeral 14.

Figures 2, 5:
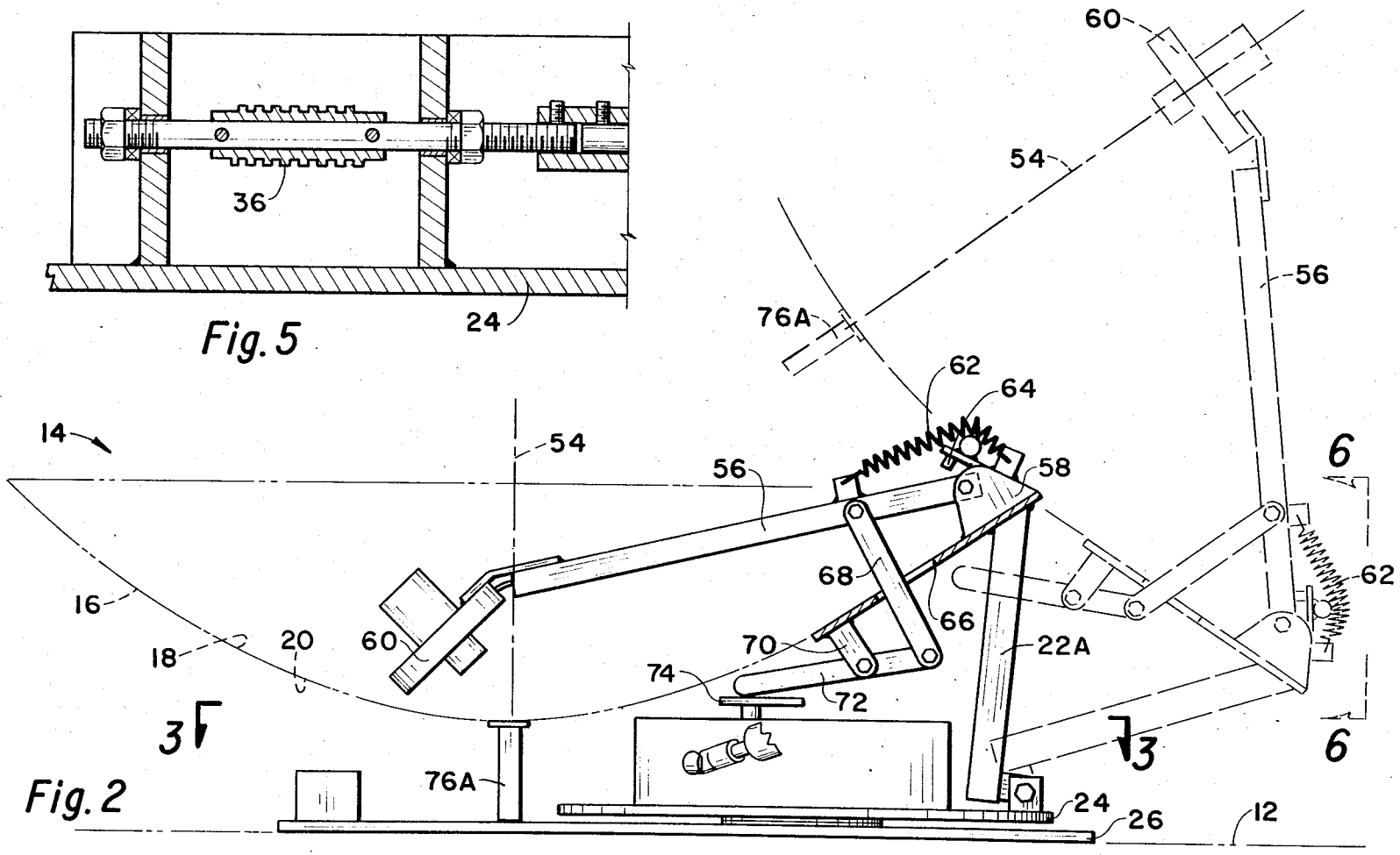
FIG. 2 is an elevational side view of the satellite receiver system of this invention showing in solid outline the position of the parabolic reflector in rest position, most of the reflector being broken away to show the internal parts and the reflector being shown in a typical operating position in dotted outline.
FIG. 5 is a cross-sectional view taken along the line 5—5 of FIG. 4 and showing the worm gear as used to rotate the support member about a vertical axis.
Figure 7:
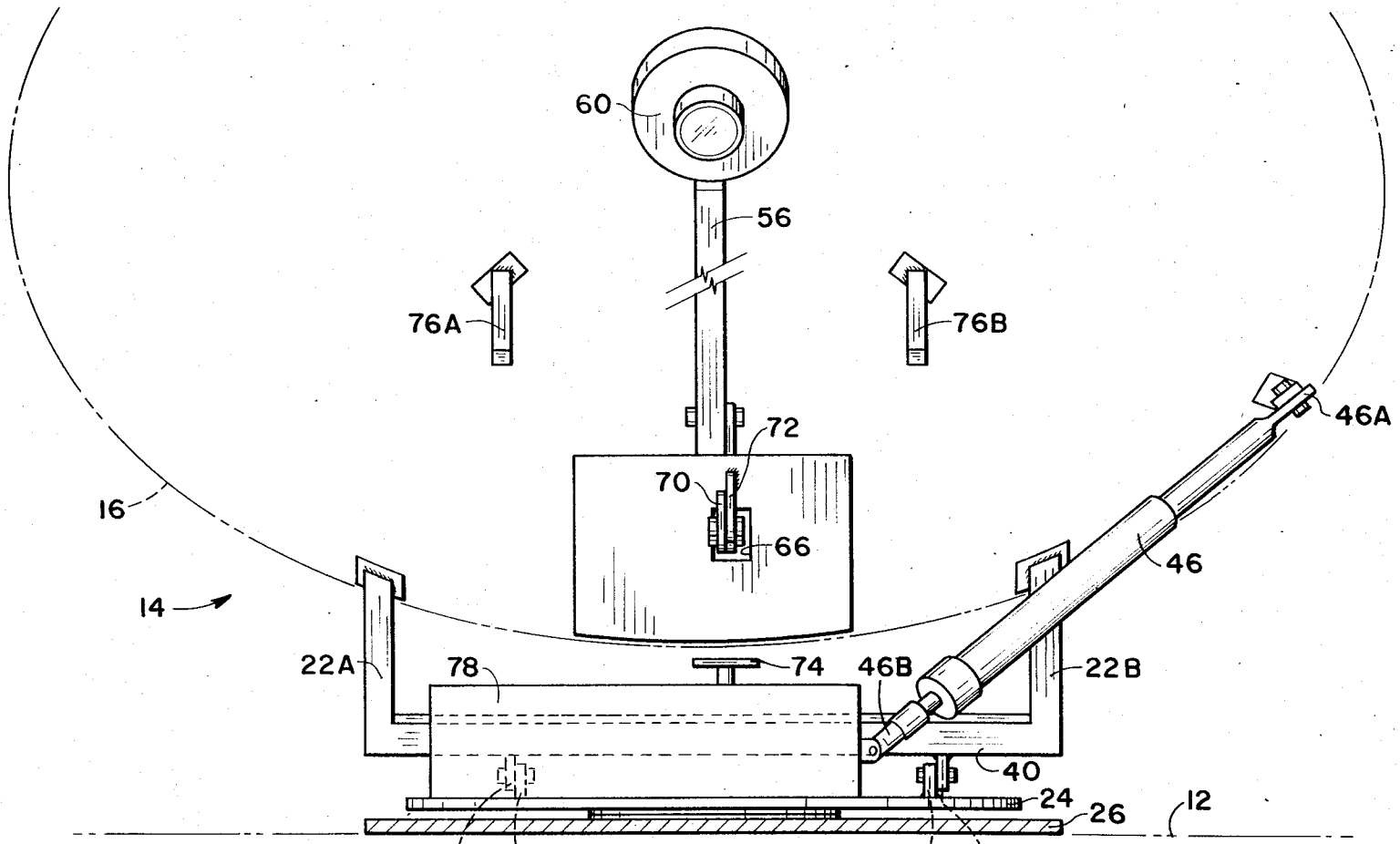
FIG. 7 is a rear view of the antenna system of this invention showing the parabolic reflector in dotted outline so as to reveal the components which are on both sides of the parabolic reflector.

The satellite receiver system is shown in detail in FIGS. 2 and 7 and in more particular detail as to certain components in the other figures. Referring first to FIGS. 2 and 7, the antenna system includes a parabolic reflector 16 which has an inner concave surface 18 and an outer convex surface 20. By means of vertical brackets 22A and 22B, the parabolic reflector 16 is pivotally supported to a support member 24 which, as illustrated, is in the form of a flat plate. Affixed to the roof 12 of the vehicle 10 is a base plate 26. Extending upwardly from the base plate 26 is a vertical post 28. The support member 24 has an opening 30 therein which receives the post 28 and which permits the support member 24 to rotate relative to the base plate 26. Bearings 32 are preferably provided to facilitate the rotation of the support member.

Figure 4:
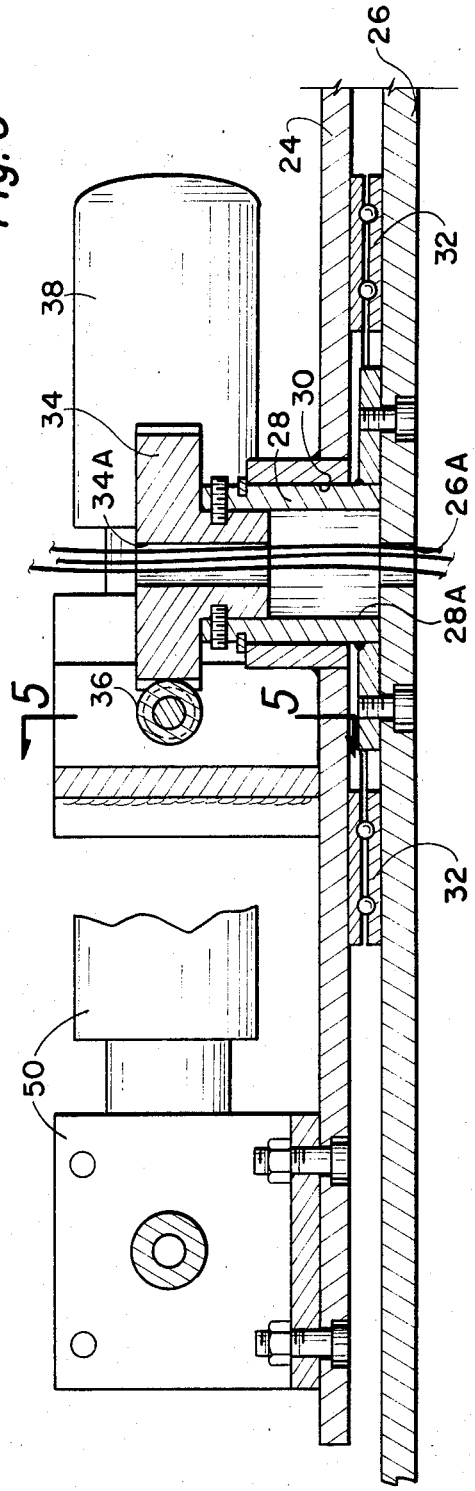
FIG. 4 is a cross-sectional view taken along the line 4—4 of FIG. 3 and showing additional details of the apparatus for orienting the parabolic reflector.
Figure 3:
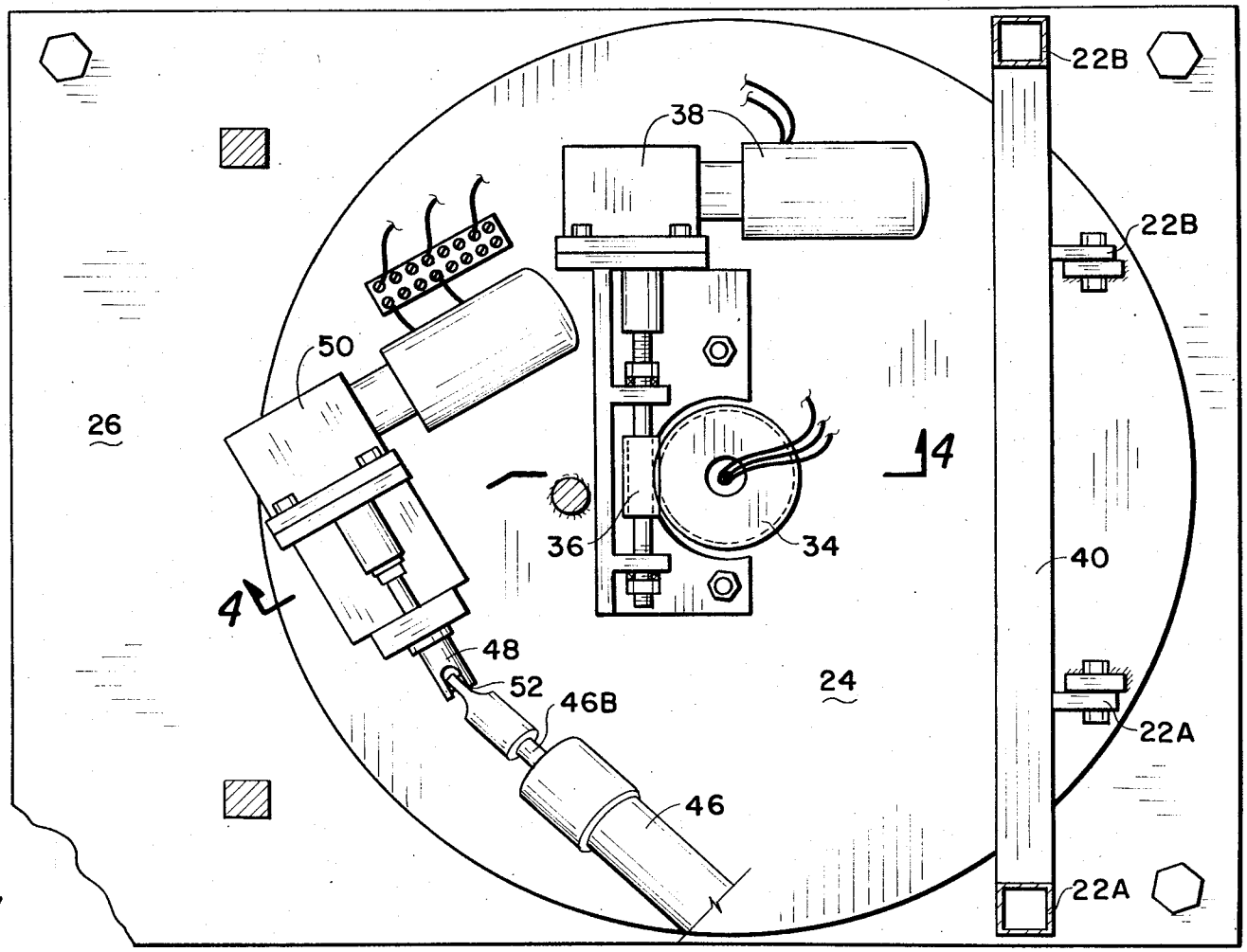
FIG. 3 is a cross-sectional view taken along the line 3—3 of FIG. 2 showing more details of the electrically driven mechanisms for orientation of the parabolic reflector.

Affixed to the upper end of post 28 is a fixed gear 34. Supported to the support member 24 about a generally horizontal axis, as seen best in FIGS. 4 and 5, is a worm gear 36 which engages the fixed gear 34. The worm gear in turn is driven by a gear motor 38 (See FIG. 3) so that by energizing the gear motor 38 the orientation of support member 24 about the vertical axis of post 28 may be controlled.

The base plate 26 has an opening 26A therein. Post 28 has opening 28A. Fixed gear 34 has opening 34A. The openings 26A, 28A and 34A are coincident about a vertical axis so as to receive conductors, such as extending to the control motors, and to convey a signal from the antenna system into the recreational vehicle.

As previously indicated, the parabolic reflector 16 has vertical brackets 22A and 22B extending therefrom, these brackets being termed vertical since they operate in a vertical plane. Connecting the lower ends of the brackets 22A and 22B is a horizontal bracket 40 which is pivotally supported to the support member 24 by means of lugs 42A and B connected to the bracket and the lugs 44A and B upstanding from the support member 24.

To control the pivotation of the parabolic reflector a screw type cylinder 46 has the first end 46A pivotally connected to the parabolic reflector rearward surface. The second end 46B is connected to the output shaft 48 of a gear motor 50 by means of a universal joint 52. As shaft 48 rotates a portion of the screw type cylinder rotates relative to the other portion to extend or retract the length of the screw type cylinder depending upon the direction of rotation. Thus it can be seen that by gear motor 38 the parabolic reflector may be oriented at any orientation of 360 degrees around a vertical axis and by gear motor 50 the pivotation of the parabolic reflector may be selected so that the reflector focal axis 54 may extend from the vertical to adjacent the horizontal to thereby enable the focal axis 54 to be aligned with a satellite transmitter at any location above the earth's horizon.

As best seen in FIG. 2, a feed arm 56 has a first end pivoted to the parabolic reflector by means of a bracket 58 extending from the reflector inner surface. At the second end of the feed arm 56 is a feed horn 60 which includes the actual signal receiving antenna (not shown) and typically also includes a low noise amplifier. The actual satellite transmitted signal is reflected by the parabolic reflector 16 and received by the feed horn 60. Therefore, the feed horn 60 must be positioned at the focal point of the parabolic reflector, which focal point is in alignment with the focal axis 54. By means of a spring 62 the feed arm 56 is automatically raised so that the feed horn 60 is in alignment with the focal axis 54 when the parabolic reflector is in the raised or operating position. A stop 64 positions the arm 56 in its correct raised, operating position.

An important feature of the invention is a means to automatically lower the feed horn 60 to within the confines of the interior concave surface 18 of the parabolic reflector when the reflector is in its rest position, that is, where the focal axis 54 is perpendicular to base plate 26. The parabolic reflector 16 has a slot 66 therein adjacent bracket 58. Received within slot 66 is a first linkage member 68 having one end pivotally secured to arm 56 at a point adjacent to and spaced from the point where the arm is pivoted to the parabolic reflector. A stub post 70 has one end affixed to the parabolic reflector rearward surface 20. A second linkage member 72 is pivoted at a point spaced between its ends to the outer end of the stub post 70. One end of the second linkage member 72 is pivotally secured to the second end of the first linkage member 68. Extending from support member 24 is a positioning member 74. When the parabolic reflector is moved to its rest position, the second end of the second linkage member 72 engages positioning member 74 to automatically pivot arm 56 in the direction towards the parabolic reflector inner surface 18 and to move the feed horn 60 within the confines of the reflector inner surface as shown in solid outline in FIG. 2. When the parabolic reflector is pivoted to an operating position the arm 56 is automatically raised by the force of spring 62 to the operating position as shown in dotted outline in FIG. 2. In this manner, the operator need only return the parabolic reflector to its rest position as shown in FIG. 1 to store the satellite antenna system in preparation for movement of the vehicle 10.

To help support the parabolic reflector, support posts 76A and 76B are secured to the reflector rearward surface 20, the post resting on base plate 26 when the reflector is in its rest position.

A cover 78 is provided for the operating mechanisms to cover portions of the tilting mechanism including portions of gear motor 50 and the rotating mechanism including gears 34 and 36.

To insure that the mechanism for lowering the parabolic reflector is not damaged when the reflector is returned to the rest position, a stop switch may be provided. In addition, the stop switch may be actuated by arm 56 as one means of providing a signal to indicate that the antenna is in actuating position.

It can be seen that the satellite antenna system of this invention fulfills the requirements of a signal receiving system for use on mobile vehicles, such as trailers and motor homes and provides a system wherein the focal axis of the parabolic reflector may be oriented in a direction towards any satellite above the earth's horizon regardless of the the orientation of the vehicle and in which the parabolic reflector can easily be returned to rest position and in such rest position, the feed horn, and its supporting arm, are automatically returned to a stored position wherein a height and wind resistance of the antenna system are reduced to a minimum.

While the invention has been described with a certain degree of particularlity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A satellite antenna particularly adapted for use on a recreation vehicle, such as a house trailer or motor home in which the vehicle has a roof surface, comprising:

a base plate means adapted to be mounted on a recreational vehicle roof surface;

a support member rotatably secured to said base means and rotatable about a generally vertical axis for at least about 360 degrees;

a parabolic satellite signal reflector having an inner concave surface and an outer convex surface and a focal axis and being pivotally secured to said support member between an operating and a rest position;

means to pivot said parabolic reflector to a rest position in which the focal axis is generally perpendicular to the vehicle roof surface and to an elevated operating position wherein the parabolic reflector focal axis is coincident with a satellite transmitter;

a signal receiving feed horn mounted on the outer end of a feed arm, the inner end of the feed arm being pivotally secured to said parabolic reflector, the arm being pivotal to a raised operating position in which said feed horn is coincident with focal apex on said focal axis; and means when said parabolic antenna is pivoted to said rest position, said feed arm is automatically pivoted to move said feed horn into said parabolic antenna.

2. A satellite antenna according to claim 1 wherein:

said base plate has a vertical post extending therefrom, said support plate having an opening therein receiving said post;

a fixed gear secured to said post above said support plate;

a worm gear rotatably supported to said base plate and engaging said fixed gear; and means to rotate said worm gear to selectably orient said base plate and thereby said parabolic reflector about the post vertical axis.

3. A satellite receiver according to claim 2 in which said means to rotate said worm gear includes remotely controllable electric motor means.

4. A satellite antenna according to claim 1 in which said means to pivot said parabolic reflector relative to said support member includes a screw cylinder having one end secured to said parabolic reflector and the other end secured to said support member, the length of the screw cylinder being determined by rotational energy input thereto.

5. A satellite antenna according to claim 2 wherein said base plate means, said post and said fixed gear each have an aligned opening therethrough whereby conductors may be fed through such aligned openings.

6. A satellite antenna according to claim 1 including:

spring means normally urging said arm and thereby said feed horn to said raised position;

a first linkage member having a first end and a second end and being pivotally affixed at the first end to said arm at a point adjacent to and spaced from said arm inner end;

a stub post having first and second ends, the first end being affixed to said parabolic reflector and extending generally from said convex rearward surface thereof;

a second linkage member having a first and second end and pivoted at a point between its ends to the second end of said stub post, and the second end thereof being pivotally attached to said first linkage member second end; and a positioning member affixed to said support member the positioning member being engaged by said first end of said second linkage member as said parabolic reflector is pivoted to said rest position to automatically pivot said arm so that said signal horn is received within the confines of said parabolic reflector.

* * * * *